US010119177B2

(12) United States Patent
Schenzel et al.

(10) Patent No.: US 10,119,177 B2
(45) Date of Patent: Nov. 6, 2018

(54) PRECIOUS METAL ALLOY FOR USE IN THE JEWELRY AND WATCH INDUSTRY

(71) Applicant: C. Hafner GmbH & Co. KG, Wimsheim (DE)

(72) Inventors: Heinz-Guenter Schenzel, Pforzheim (DE); Thomas Laag, Pforzheim (DE)

(73) Assignee: C. HAFNER GMBH & CO. KG, Wimsheim (DE)

( * ) Notice: Subject to any disclaimer, the term of this patent is extended or adjusted under 35 U.S.C. 154(b) by 178 days.

(21) Appl. No.: 15/091,821

(22) Filed: Apr. 6, 2016

(65) Prior Publication Data

US 2016/0215365 A1 Jul. 28, 2016

Related U.S. Application Data

(63) Continuation of application No. PCT/EP2015/000291, filed on Feb. 11, 2015.

(51) Int. Cl.

| | |
|---|---|
| ***C22C 5/04*** | (2006.01) |
| ***A44C 27/00*** | (2006.01) |
| ***G04B 37/22*** | (2006.01) |
| ***C22C 30/00*** | (2006.01) |

(52) U.S. Cl.

CPC ..... *C22C 5/04* (2013.01); *A44C 27/003* (2013.01); *C22C 30/00* (2013.01); *G04B 37/22* (2013.01)

(58) Field of Classification Search

CPC ..... C22C 5/04; A44C 27/003; G04B 37/22
USPC ..... 420/462, 463, 465, 580
See application file for complete search history.

(56) References Cited

U.S. PATENT DOCUMENTS 2,303,405 A * 12/1942 Sivil ..... C22C 5/04 420/463
2,967,792 A * 1/1961 Ruthardt ..... C22C 5/04 148/405

FOREIGN PATENT DOCUMENTS

| | | | |
|---|---|---|---|
| DE | 1 080 785 B | | 4/1960 |
| DE | 1080785 | * | 4/1960 |
| DE | 1 086 442 B | | 8/1960 |
| DE | 1086442 | * | 8/1960 |
| DE | 10 2004 024 026 A1 | | 9/2005 |
| DE | 10 2008 050 135 | | 4/2010 |
| EP | 1 548 135 A1 | | 6/2005 |
| EP | 2 420 583 A2 | | 2/2012 |

* cited by examiner

*Primary Examiner* — C Melissa Koslow
(74) *Attorney, Agent, or Firm* — Hackler Daghighian Martino & Novak

(57) ABSTRACT

A precious metal alloy includes palladium and rhodium for manufacturing jewelry pieces like jewelry, jewelry articles, bijouterie, watches and watch cases and/or writing utensils and/or a component thereof. The precious metal alloy used includes palladium in an amount of 40-60% by weight and rhodium in an amount of 40-60% by weight, and that the precious metal alloy used may include gold, platinum, ruthenium and/or iridium in an amount of between greater than 0 and 10% by weight, or alternatively in an amount of between 2% by weight and 5% by weight, or alternatively in an amount of 3% by weight. The corresponding amount of rhodium and/or palladium is then replaced by the aforementioned secondary alloy components, wherein the amounts of rhodium and palladium as well as of the provided aforementioned secondary alloy components complement substantially to 100% by weight.

12 Claims, No Drawings

PRECIOUS METAL ALLOY FOR USE IN THE JEWELRY AND WATCH INDUSTRY

CROSS-REFERENCE TO RELATED APPLICATIONS

This continuation application claims priority to PCT/EP2015/000291 filed on Feb. 11, 2015 and also the German application number 10 2014 001 718.4 filed on Feb. 11, 2014 and German application number 20 2014 001 179.6 filed on Feb. 11, 2014, the entire contents of which all applications are fully incorporated herein with these references.

DESCRIPTION

Field of the Invention

The present invention relates to the use of a precious metal alloy, comprising palladium and rhodium, for items in the jewelry and watch making industry.

Background of the Invention

In the jewelry and watch making industry a particularly white metal color of a precious metal alloy is desired, as hereby the brilliance of stones, especially of precious stones such as diamonds, being present in a piece of jewelry made from this precious metal alloy, is supported in a particularly good manner. White gold is therefore very often coated with an electroplated rhodium layer to improve the less white color of white gold or of a white gold alloy, which is used for manufacturing the piece of jewelry. Rhodium is known to be the precious metal with the best white color. Such an approach is described in DE 10 2008 050 135 for example. The disadvantage here is not only that, when manufacturing the piece of jewelry of white gold or of a white gold alloy, an additional process—the rhodium plating of this piece of jewelry—must be carried out. More important for a buyer of a such crafted piece of jewelry is that electroplated rhodium layers are subject to natural wear when using the piece of jewelry, so that the rhodium coating of the piece of jewelry has to be renewed after a certain time, since by the wear, the less white color of the base material of the piece of jewelry, this means the white gold alloy, has become visible.

To manufacture a piece of jewelry of rhodium or a rhodium alloy as massive alloy is impractical because rhodium is very brittle and is therefore not suited or at least not suitable to a sufficient extent for the manufacturing of jewelry pieces like jewelry, bijouterie, watch cases, writing utensils, and the like.

Platinum as well as high-alloyed platinum alloys such as e. g. an alloy with 95% by weight of platinum possess for most of the applications occurring in the jewelry and watch making industry a sufficiently white color and are generally regarded as particularly valuable because platinum is the precious metal with the highest metal price.

Palladium is a white precious metal with the lowest reflectance of light and therefore appears gray in comparison to platinum alloys. For this reason, palladium is currently used only for selected applications in the jewelry and watch making industry, where a "perfect white" color of a product made of palladium or a palladium alloy is not or not of primary importance. Compared to platinum, palladium has not only the advantage that it is about 40% lighter than this precious metal. Rather, the metal price for palladium is significantly lower than that of platinum. The two aforementioned advantages can be utilized only insufficiently in the jewelry and watch making industry due to the disadvantageous color—palladium appears gray—described above.

From DE 1 086 442 B the use of a palladium-rhodium-alloy as a material for spinning nozzles is known. The alloy used for this purpose consists of 25% to 50%, in particular 25% to 42% rhodium and as the remaining part palladium. Up to 15%, preferably up to 10% and in particular less than 5% of the palladium may in this case be replaced by other platinum metals, gold, silver, iron, cobalt, nickel, copper and/or manganese, wherein the content of non-precious metals should not to be more than 3%, with the limitation that up to a rhodium content of 30% the iridium content is <7%. The properties, which distinguish the aforementioned alloys for use as a material for spinning nozzles, are that these alloys, also in a tempered state, still have a certain elongation, so that the risk of cracking due to embrittlement is largely eliminated.

From DE 1 080 785 B the use of a palladium-rhodium-alloy as material for electrical contacts and potentiometer is known. The alloy to be used herein consists of 5% to 45%, preferably 15% to 40% rhodium and palladium as rest. The alloy can contain up to 15%, preferably up to 5% in total of one or more other platinum metals, gold, silver, nickel, cobalt or copper, with the limitation that in the presence of iridium the iridium content is less than 10%. The properties, which especially distinguish these alloys for the production of electrical contacts and potentiometers, are that the hardness and closing strength is retained even if a mechanical stress occurs at a contact. Moreover, these alloys should be manufacturable with high uniformity and have a consistently uniform contact resistance. Their use is, according to the information contained in the aforementioned publication, then particularly advantageous if an absolute switching reliability and uniform electrical conditions, a constancy of the output resistance at the contact point and a possibly low contact drifting when opening the contact points of the electrical contact established therewith or of the potentiometer is required.

From EP 2 420 583 A2 of the applicant an ideally white, tarnish-resistant precious metal jewelry alloy is known, comprising rhodium with a weight fraction of 40 weight percent to 70 weight percent and platinum in a weight fraction of 60 weight percent to 30 weight percent, wherein the weight percentage of platinum and the weight percentage of rhodium essentially complement to 100 weight percent. In the aforementioned document, the use of such rhodium-platinum-alloy for manufacturing a piece of jewelry such as a watch, jewelry, a jewelry item or a writing utensil is also described.

From EP 1 548 135 A1, an alloy for use in high temperature applications is known, in particular for gas turbines, aircraft engines and for devices for generating energy. The alloy described therein comprises at least 50 atomic percent rhodium and up to 49 atomic percent of a first material consisting of at least one of the elements palladium, platinum, iridium or a combination thereof, and between 1 atomic percent and 15 atomic percent of a second material consisting of the elements, tungsten, rhenium or a combination thereof, and up to 10 atomic percent of a third material, which consists of chromium or mixtures thereof, wherein the alloy has an A1-structured phase at temperatures >1000° C. in an amount of at least 90 volume percent.

From DE 10 2004 024 026 A1 a catalyst for $N_2O$ decomposition in the Ostwald process is known, which has a support and a rhodium, rhodium/palladium or rhodium oxide coating deposited thereon.

DE 38 12 565 C1 describes the use of castable palladium alloys in dental technology. The alloys used in this case contain 60 weight percent to 99.5 weight percent palladium, 0.5 weight percent to 40 weight percent of iridium and 0 weight percent to 25 weight percent ruthenium and/or rhodium.

SUMMARY OF THE INVENTION

It is an object of the present invention to provide an alloy based on palladium for use in the jewelry and watch industry for manufacturing of items like jewelry, bijouterie, jewelry articles or writing utensils, watches, watch cases as well as components of the aforementioned goods, which in comparison to pure or highly-alloyed palladium possess a "whiter" color.

This object is achieved according to the invention by the use of a precious metal alloy, which provides that the used precious metal alloy comprises palladium in an amount of 40-60% by weight and rhodium in an amount of 40-60% by weight, and that the precious metal alloy comprises preferably gold, platinum, ruthenium and/or iridium in an amount between greater than 0 to 10% by weight, preferably in an amount between 2% by weight and 5% by weight, more preferably in an amount of 3% by weight, wherein by the aforementioned secondary alloy components the corresponding amount of rhodium and/or palladium is replaced, and wherein the amounts of rhodium and palladium as well as of the preferably provided aforementioned secondary alloy components substantially complement to 100% by weight.

DETAILED DESCRIPTION OF THE PREFERRED EMBODIMENTS

The above-described precious metal alloy is particularly suitable for use in the jewelry and watch making industry, because it has a white color, which is comparable to that of rhodium or a rhodium coating or at least of platinum or of platinum alloys. The precious metal alloy therefore appears in an advantageous manner particularly bright and is therefore particularly suitable for the manufacturing of jewelry pieces, in particular of jewelry pieces having precious stones like diamonds. As the precious metal alloy used according to the invention—as it is metallurgically produced and not just a coating—has this color itself, it is no longer necessary for the manufacturing of jewelry pieces to improve their color by a further treatment step such as an electroplated rhodium process.

Another advantage of the precious metal alloy used according to the invention is that in terms of weight it is significantly lighter than a platinum alloy of equal or comparable white color, and that it is significantly less expensive to manufacture than such a platinum alloy, because—as already stated above—the metal price of rhodium and palladium is much lower than that of platinum.

The precious metal alloy used according to the invention has a hardness in the range of 180-200 HV and is therefore particularly well suited for manufacturing a piece of jewelry by hot forming. It has a hardness in the range of more than 250 HV, preferably more than 300 HV, and therefore is distinguished by a good wear resistance. Pieces of jewelry manufactured from the precious metal alloy used according to the invention are distinguished by the fact that their bright surface is maintained for a long time.

An advantageous embodiment of the invention provides that the precious metal alloy used according to the invention comprises palladium in an amount of 47 to 53% by weight and rhodium in an amount of 53 to 47% by weight, wherein the amounts of rhodium and palladium as well as the aforementioned impurities and admixtures complement to 100% by weight. Such a measure has the advantage of an even whiter color of the inventive precious metal alloy.

A further advantageous embodiment of the invention provides that the precious metal alloy used according to the invention comprises 50-52% by weight of palladium and 50-48% by weight of rhodium, wherein the aforementioned amounts of palladium and rhodium—apart from aforementioned impurities and admixtures—complement to 100% by weight.

A further advantageous embodiment of the invention provides that the precious metal alloy used according to the invention comprises 50% by weight of palladium and 50% by weight of rhodium, wherein these two amounts of palladium and rhodium—apart from aforementioned impurities and admixtures—complement to 100% by weight.

A further advantageous embodiment of the invention provides that the precious metal alloy according to the invention comprises 47-50% by weight of palladium and 53-50% by weight of rhodium, wherein the amounts of palladium and rhodium—apart from aforementioned impurities and admixtures—complement to 100% by weight.

A further advantageous embodiment of the invention provides that the alloy according to the invention comprises gold, platinum, ruthenium and/or iridium in an amount of together more than zero and maximum 10% by weight, preferably 2% by weight to 5% by weight, more preferably 3% by weight, wherein the amounts of rhodium and palladium as well as the aforementioned secondary alloy components complement to 100% by weight and the secondary alloy components preferably replace the corresponding amount of rhodium.

Further advantages and embodiments of the invention are subject of the dependent claims.

Further details and advantages of the invention are described in the exemplary embodiments, which are described below.

The first embodiment of the precious metal alloy described comprises 40-60% by weight of palladium and 60-40% by weight of rhodium, wherein the aforementioned amounts of palladium and rhodium complement to 100% by weight, apart from the usual impurities and admixtures of these metals. There is no need for explanation for the skilled person in that the aforementioned weight amounts and the weight amounts of the following embodiments are to be understood such that these include the usual tolerances occurring in a metallurgical manufacturing process.

The described precious metal alloy has a yellowness index YI in the range from 9 to 10. Such yellowness index YI of less than 10 is regarded as very low for such precious metal alloys and is typically achieved only by rhodium itself or a rhodium-platinum-alloy.

The lightness value (L* value) of the described alloy is in the range between 86 and 88, which is surprising, since this L* value is significantly higher than that of the pure precious metals palladium or rhodium: rhodium has an L* value of 83.8 and palladium one of 81.1 The precious metal alloy described appears therefore in an advantageous manner very bright, thus it has a very white color, which is at the level of a platinum alloy with 95% by weight of platinum. The precious metal alloy described thus hardly differs visually from rhodium, a layer of rhodium electroplated on a base material, a rhodium-platinum alloy or at least from platinum or a platinum alloy with 95% by weight platinum, but can be manufactured cost-effective in an advantageous manner.

The values listed above were determined by measurements and the standard conditions defined by DIN 5033. The other values of the L*a*b*-color space are for the described embodiment in the range of $0.7 \leq a^* \leq 0.9$ and $3.5 \leq b^* \leq 4$.

A second embodiment of the precious metal alloy provides that the precious metal alloy comprises 53-47% by weight of palladium and 47-53% by weight of rhodium, wherein the amounts of palladium and rhodium, taking into account the usual impurities and admixtures as well as the corresponding metallological tolerance limits, complement to 100% by weight. Such an alloy has an L* value in the range of 87.3 and a yellowness index YI in the range of 9.7. The color parameters a* and b* are approximately 0.8 and 3.8 respectively.

A third embodiment of the precious metal alloy provides that the precious metal alloy comprises 52-50% by weight of palladium and 48-50% by weight of rhodium, wherein the amounts of palladium and rhodium—apart from the usual admixtures and impurities and alloy tolerances—complement to 100% by weight. Such an alloy has a yellowness index YI of 9.8, an L* value of 87.3. The color parameters a* and b* are 0.8 and 3.8 respectively.

A fourth embodiment of the precious metal alloy provides that it comprises 50% by weight of palladium and 50% by weight of rhodium, wherein the amounts of palladium and rhodium—apart from the usual admixtures and impurities and alloy tolerances—complement to 100% by weight. Such an alloy has a yellowness index YI in the range of 9.8. The lightness L* is in the range of 87.3 and the color parameters a* and b* are 0.8 and 3.8 respectively.

A fifth embodiment of the precious metal alloy provides that the precious metal alloy comprises 47-50% by weight of palladium and 53-50% by weight of rhodium, wherein the amounts of rhodium and palladium—apart from usual admixtures and impurities and alloy tolerances—complement to 100% by weight. Such a precious metal alloy has a yellowness index YI in the range of 9.8. The lightness L* is in the range of 87.4 and the color parameters a* and b* are 0.9 and 3.7 respectively.

A sixth embodiment of the precious metal alloy provides that the precious metal alloy comprises 40% by weight of palladium and 60% by weight of rhodium, wherein the amounts of rhodium and palladium—apart of usual admixtures and impurities and alloy tolerances—complement to 100% by weight. Such an alloy has a yellowness index YI in the range of 9.0. The lightness L* is in the range of 87.1 and the color parameters a* and b* are 0.8 and 3.5 respectively.

Among the aforementioned precious metal alloys the fourth embodiment is preferred, which is an alloy having a weight fraction of 50% by weight of palladium and 50% by weight of rhodium. As results from the above-stated color parameters, it has a yellow-blue-value b* of 3.8, which is close to the arithmetic mean of the corresponding b* values of rhodium (b*=2.8) and palladium (b*=6.0). The green-red-value a* of the alloy of the fourth embodiment is slightly higher than the arithmetic mean of the primary alloy components of this alloy; rhodium has an a* value of a*=0.6 and palladium has such a value of a*=0.4. The green-red value a* of the alloy of the fourth embodiment is about 0.8, but is substantially still near zero and therefore still negligible.

Surprisingly, it has been found that the lightness value L* of the described alloys, particularly the alloy of the fourth embodiment L*=87.3, is significantly higher than that of the pure materials. Palladium has a lightness value L* of 81.1 and a yellowness index YI of 13.6

The corresponding values of rhodium are L*=83.8 and YI=6.8. The L* value of the alloy of the fourth embodiment L*=87.3 is at the level of a 95% platinum alloy, so that this alloy appears very bright, which also results from the yellowness index of YI=9.8. Thus, particularly the precious metal alloy according to the fourth embodiment can hardly be distinguished visually from rhodium, an electroplated rhodium layer, a rhodium-platinum-alloy, or at least from platinum or a highly alloyed platinum alloy such as Pt 950.

It is preferable that gold, platinum, ruthenium and/or iridium is/are added to the above-described precious metal alloys in an amount of more than 0% by weight and a maximum of 10% by weight as secondary alloy components, where the amounts of rhodium and palladium as well as those of the secondary alloy components complement to 100% by weight, apart from the usual admixtures and impurities and alloy tolerances. Such a measure has the advantage that the cast structure of such a precious metal alloy has a finer microstructure.

For the manufacturing of the aforementioned precious metal alloy comprising gold, platinum, ruthenium and/or rhodium from an alloy according to any of the first five embodiments, it is preferably provided that the corresponding amount of rhodium is replaced by the amount of the aforementioned secondary alloy components added to these alloys. However, it is also possible that not rhodium, but palladium is replaced. Likewise, a combination of the two above mentioned measures is possible, namely that the corresponding amounts of rhodium and palladium are replaced by the aforementioned secondary alloy components.

Surprisingly, it has been found that the described precious metal alloys are well suited for jewelry casting after the lost wax process, wherein conventional equipment and embedding compounds for the casting of precious metal alloys may be used. The castings produced from the described alloys have substantially no or only a low porosity. They have a hardness in the range of 180-200 HV. This high cast hardness has the advantage that for the manufacturing of pieces of jewelry finished shapes can be casted and their hardness needs not to be improved retrospectively from a variety of applications by forming.

Another advantage of the described precious metal alloys is that surface defects due to reactions with an embedding compound have practically not been observed. The unexpectedly low solidification shrinkage of the described precious metal alloys in comparison to other jewelry materials such as platinum 950 or white gold 750 reduces the risk of shrinkage porosity, which is a major problem in jewelry casting.

Another advantage of the described precious metal alloys is that gas and/or embedding compound reactions are almost excluded, as both rhodium and palladium have a high chemical resistance. This also means that a recasting of remainders of the described precious metal alloys can be carried out without major difficulties, since these described precious metal alloys are not affected by chemical reactions during the jewelry casting process. This thereby given reusability of remainders of the casting process leads to good material utilization.

Another advantage of the described precious metal alloys in connection with jewelry casting is that cast pieces manufactured by such a jewelry casting have near net shape dimensions, which in connection with a good recasting ability brings an economical use of materials.

The cast hardness of the described alloys in the range of 180-200 HV, in particular 190 HV, has the advantage that these alloys can be processed best by a hot forming process, for which purpose a temperature above the miscibility gap at about 845° C. is suitable. Particularly suitable is a temperature of 1200-1300° C. The advantage is that at such a temperature hammering or rolling is still possible, wherein deformations up to 10% per forming step are possible.

After hot forming and a thereby achieved transformation of the cast structure also a cold forming with machines, as they are commonly used in the processing of precious metals, is possible. The solution annealed state (annealing at 1000° C. followed by quenching) has a hardness of 130 HV to 140 HV. By cold forming, a hardness greater than 250 HV, preferably greater than 300 HV, can be achieved. The high hardness of the described precious metal alloys provides a good wear resistance and thus provides a good preservation of a bright surface of a jewelry made from the described alloys, like a piece of jewelry, a watch, a watch case, a writing utensil, of jewelry articles, articles of bijouterie or the like, as well as components of the aforementioned items.

What is claimed is:

1. A precious metal alloy, comprising palladium and rhodium, for manufacturing jewelry pieces like jewelry, jewelry articles, bijouterie, watches, watch cases, writing utensils and/or a component thereof, the precious metal alloy comprising:

a first alloy component comprising palladium in an amount of 40-60% by weight and rhodium in an amount of 47-53% by weight;

a secondary alloy component comprising gold, platinum, ruthenium and/or iridium in an amount between greater than 0 to 10% by weight;

wherein by the secondary alloy components the corresponding amount of first alloy components are replaced; and wherein the amounts of the first and secondary alloy components are substantially 100% by weight.

2. The precious metal alloy according to claim 1, wherein the secondary alloy component comprises gold, platinum, ruthenium and/or iridium in an amount between 2% by weight and 5% by weight.

3. The precious metal alloy according to claim 1, wherein the secondary alloy component comprises gold, platinum, ruthenium and/or iridium in an amount of 3% by weight.

4. The precious metal alloy according to claim 1, wherein the first alloy component comprises palladium in an amount of 50-52% by weight and rhodium in an amount of 48-50% by weight.

5. The precious metal alloy according to claim 1, wherein the first alloy component comprises palladium in an amount of 50% by weight and rhodium in an amount of 50% by weight.

6. The precious metal alloy according to claim 1, wherein the first alloy component comprises palladium in an amount of 47-50% by weight and rhodium in an amount of 50-53% by weight.

7. The precious metal alloy according to claim 1, wherein the first alloy component comprises palladium in an amount of 40% by weight.

8. A precious metal alloy, comprising palladium and rhodium, for manufacturing jewelry pieces like jewelry, jewelry articles, bijouterie, watches, watch cases, writing utensils and/or a component thereof, the precious metal alloy comprising:

a first alloy component comprising palladium in an amount of 47-53% by weight and rhodium in an amount of 47-53% by weight;

a secondary alloy component comprising gold, platinum, ruthenium and/or iridium in an amount between greater than 0 to 10% by weight;

wherein by the secondary alloy components the corresponding amount of first alloy components are replaced; and wherein the amounts of the first and secondary alloy components are substantially 100% by weight.

9. The precious metal alloy according to claim 8, wherein the secondary alloy component comprises gold, platinum, ruthenium and/or iridium in an amount between 2% by weight and 10% by weight.

10. The precious metal alloy according to claim 8, wherein the secondary alloy component comprises gold, platinum, ruthenium and/or iridium in an amount between 2% by weight and 5% by weight.

11. A jewelry piece like jewelry, jewelry articles, bijouterie, watches, watch cases, writing utensils and/or a component thereof, wherein the jewelry piece is made of a precious metal, the precious metal alloy comprising:

a first alloy component comprising palladium in an amount of 40-60% by weight and rhodium in an amount of 47-53% by weight;

a secondary alloy component comprising gold, platinum, ruthenium and/or iridium in an amount between greater than 0 to 10% by weight;

wherein by the secondary alloy components the corresponding amount of first alloy components are replaced; and wherein the amounts of the first and secondary alloy components are substantially 100% by weight.

12. A jewelry piece like jewelry, jewelry articles, bijouterie, watches, watch cases, writing utensils and/or a component thereof, wherein the jewelry piece is made of a precious metal, the precious metal alloy comprising:

a first alloy component comprising palladium in an amount of 47-53% by weight and rhodium in an amount of 47-53% by weight;

a secondary alloy component comprising gold, platinum, ruthenium and/or iridium in an amount between greater than 0 to 10% by weight;

wherein by the secondary alloy components the corresponding amount of first alloy components are replaced; and wherein the amounts of the first and secondary alloy components are substantially 100% by weight.

* * * * *